US007014084B2

(12) United States Patent
Mochizuki et al.

(10) Patent No.: US 7,014,084 B2
(45) Date of Patent: Mar. 21, 2006

(54) STAPLING APPARATUS WITH INTERCONNECTED FEEDING AND CLINCHING

(75) Inventors: Naoto Mochizuki, Yamanashi-ken (JP); Toshiro Fukasawa, Yamanashi-ken (JP)

(73) Assignees: ACCO Brands USA LLC, Lincolnshire, IL (US); NISCA Corporation, Yamanashi-Ken (JP)

( * ) Notice: Subject to any disclaimer, the term of this patent is extended or adjusted under 35 U.S.C. 154(b) by 0 days.

(21) Appl. No.: 10/362,153

(22) PCT Filed: Aug. 31, 2001

(86) PCT No.: PCT/IB01/01602

§ 371 (c)(1),
(2), (4) Date: Feb. 19, 2003

(87) PCT Pub. No.: WO02/18112

PCT Pub. Date: Mar. 7, 2002

(65) Prior Publication Data

US 2004/0118895 A1 Jun. 24, 2004

(30) Foreign Application Priority Data

Sep. 1, 2000 (JP) ..... 2000-266323

(51) Int. Cl.
*B27F 7/38* (2006.01)

(52) U.S. Cl. ..... 227/1; 227/227; 227/119; 227/131; 227/135

(58) Field of Classification Search ..... 227/1, 227/131, 135, 136, 155, 119
See application file for complete search history.

(56) References Cited

U.S. PATENT DOCUMENTS

| | | | | |
|---|---|---|---|---|
| 2,938,212 A | | 5/1960 | Lerner | |
| 3,009,156 A | | 11/1961 | Lerner | |
| 4,378,085 A | * | 3/1983 | McVeigh | 227/79 |
| 4,573,625 A | * | 3/1986 | Olesen et al. | 227/131 |
| 4,588,121 A | * | 5/1986 | Olesen | 227/120 |
| 4,720,033 A | | 1/1988 | Olesen | |
| 4,770,334 A | * | 9/1988 | Hoshi et al. | 227/85 |
| 5,230,457 A | * | 7/1993 | Hiroi et al. | 227/2 |
| 5,791,548 A | * | 8/1998 | Udagawa et al. | 227/131 |
| 5,806,750 A | * | 9/1998 | Yamanushi et al. | 227/155 |
| 5,836,502 A | * | 11/1998 | Kanai et al. | 227/131 |
| 6,050,471 A | * | 4/2000 | Yagi | 227/120 |
| 2004/0046000 A1 | | 3/2004 | Mochizuki et al. | |

FOREIGN PATENT DOCUMENTS

WO WO 02/53328 A2 11/2002

* cited by examiner

*Primary Examiner*—Rinaldi I. Rada
*Assistant Examiner*—Nathaniel Chukwurah
(74) *Attorney, Agent, or Firm*—Michael Best & Friedrich LLP

(57) ABSTRACT

A stapler apparatus of the type using continuous belt-formed staples 200 includes a staple feed claw 25 for advancing the staples 200 sequentially to a stapling position 103, and a drive means 50 for driving the staples 200 drawn to the stapling position 103. A clincher means 40 bends the ends of the staples 200 driven into the sheets and pivots a staple feed pawl 25 interlocked to the staple bending operation of the clincher means 40 for sequentially feeding the staples 200 to the stapling position 103. This construction lightens the load on the drive means to staple sheet stacks, facilitates smooth driving operation of the drive means, and reduces the occurrences of trouble.

13 Claims, 14 Drawing Sheets

STAPLING APPARATUS WITH INTERCONNECTED FEEDING AND CLINCHING

BACKGROUND OF THE INVENTION

The present invention relates to a stapler which binds a bundle of sheets such as a plurality of documents printed with a copying machine, a printer, or a composite of machines thereof, etc., with staples.

Conventionally, this type of stapler has a staple feed pawl which successively advances and feeds staples composed of a belt roll of staples or stacked sheets of sheet-shaped staples loaded in a cartridge to a driving position, arranges a driver means for driving staples into the bundle of sheets on the side provided with the staple feed pawl, arranges a clincher means for appropriately bending the ends of the staple driven and pierced through the bundle of sheets with the driver means on the opposite side with the bundle of sheets as a boundary, and staples the bundle of sheets interposed between this driver means and the clincher means by swinging in the direction for being made adjacent to each other or separated from each other.

SUMMARY OF THE INVENTION

However, the advance feeding of staples at this time is executed by interlocking the charging operation of the staple feed pawl with the operation of driving staples into the bundle of sheets with the driver means and the advance feeding operation of the staple feed pawl is executed according to the reciprocating movement of the driver means.

However, in the method for charging the staple feed pawl by interlocking with the operation of driving staples into the bundle of sheets with the driver means, in addition to a great load being applied to the driver means just in the operation of driving staples into the bundle of sheets, additional load was added by charging the staple feed pawl, and depending on the condition such as the type of sheet, thickness of the bundle, etc., this was one reason for the occasional occurrence of so-called binding defect of not being able to execute driving of the staples completely due to the load thereof.

The purpose of the present invention is to give consideration to the aforementioned problem in the conventional stapler and suppress the occurrence of trouble of binding defect by reducing the load when driving staples into a bundle of sheets as much as possible, executing a smooth staple driving process without executing the feeding of staples with the driving means, which has the greatest influence on the driving performance during the stapling operation, focusing on the clincher operation executed after driving the staples, and executing the staple feeding operation by linking to this clincher operation.

The stapler apparatus of the present invention is comprised of continuous sheet shaped staples, a staple feeding means for feeding these staples to the driving position, a driving means for driving the staples at the driving position, and a clincher means for bending the staples driven with the driving means, and is equipped with an interlock operating means which operates said staple feeding means by being interlocked to the staple bending operation of the aforementioned clincher means. The aforementioned staple feeding means of the stapler apparatus in the present invention is composed from a friction roller, which contacts the continuous sheet shaped staples and rotates. The aforementioned staple feeding means of the stapler apparatus in the present invention is composed from a feed pawl, which contacts the continuous sheet shaped staples and reciprocates. The aforementioned clincher means of the stapler apparatus in the present invention includes a contact piece, which contacts the staples driven with the driving means and a clinch lever, which moves this contact piece and the aforementioned interlocked operating means is composed from this clinch lever and the staple feeding means. In the stapler apparatus of the present invention, the aforementioned driving means and clincher means are arranged at opposing positions by interposing the staples along with the aforementioned staple feeding means being positioned on the clincher means side.

The stapler apparatus of the present invention is equipped with continuous sheet shaped staples, a staple feeding means which contacts these staples and reciprocates, an resilient means which urges this staple feeding means to the staple driving position side, a driver means which drives staples at the driving position, a clincher member which bends the staples driven with this driver means, and a clincher lever which moves this clincher member to the staple bending position and the retracted position retracted from the staple bending position, and the aforementioned clincher lever and staple feeding means are arranged to be able to make contact and to be separated. The aforementioned resilient means is charged with the movement of the aforementioned clincher lever in the stapler apparatus of the present invention to the staple bending position and the resilient force of the resilient means is bestowed to the staple feeding means with the movement to the retracted position.

Below, an embodiment of a stapler according to the present invention will be described in accordance with the figures.

DESCRIPTION OF THE REFERENCE NUMERALS

Figure 1:
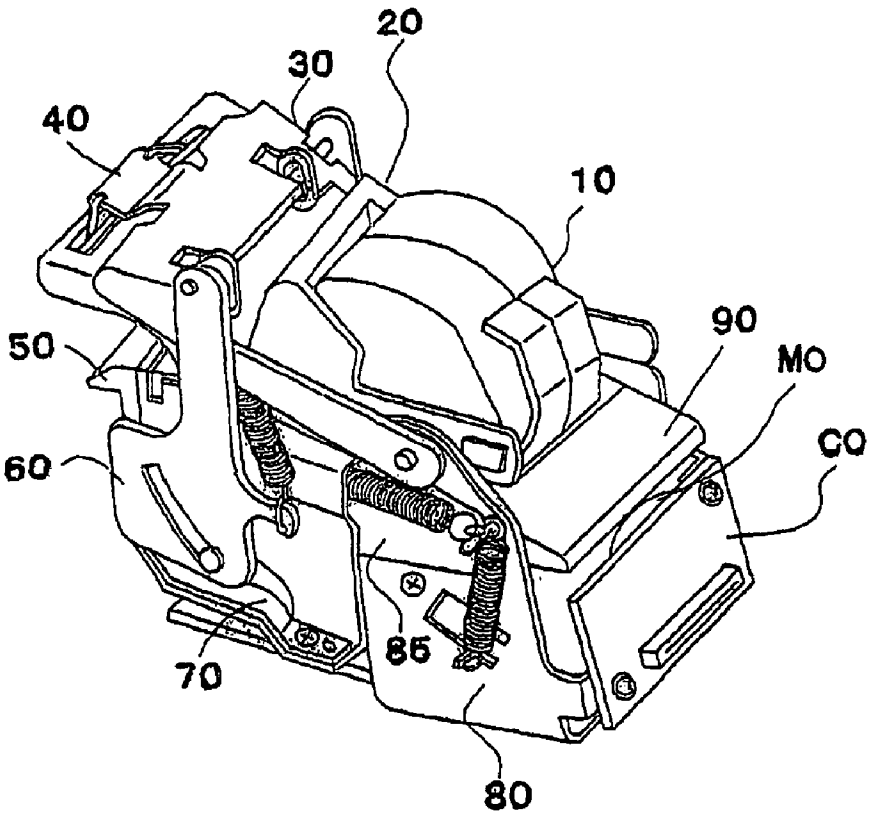
FIG. 1 is a plan view of a stapler according to the present invention.

10 Staple cartridge
20 Cartridge holder
30 Anvil unit

40 Clincher
50 Paper guide unit
60 Joint lever
70 Paper thickness absorption leaf spring
80 Main body frame
90 Lock lever
MO Motor
CO Connector base
SE No staples/cartridge installation detection sensor
HP Stapler home position sensor detector

DETAILED DESCRIPTION

FIG. 1 shows a plan view of a stapler, in which 10 is a staple cartridge, 20 is a cartridge holder, 30 is an anvil unit, 40 is a clincher, 50 is a paper guide unit, 60 is a joint lever, 70 is a paper thickness absorbing leaf spring, 80 is a main body frame, 90 is a lock lever, MO is a motor, and CO is a connector base.

Figure 2:
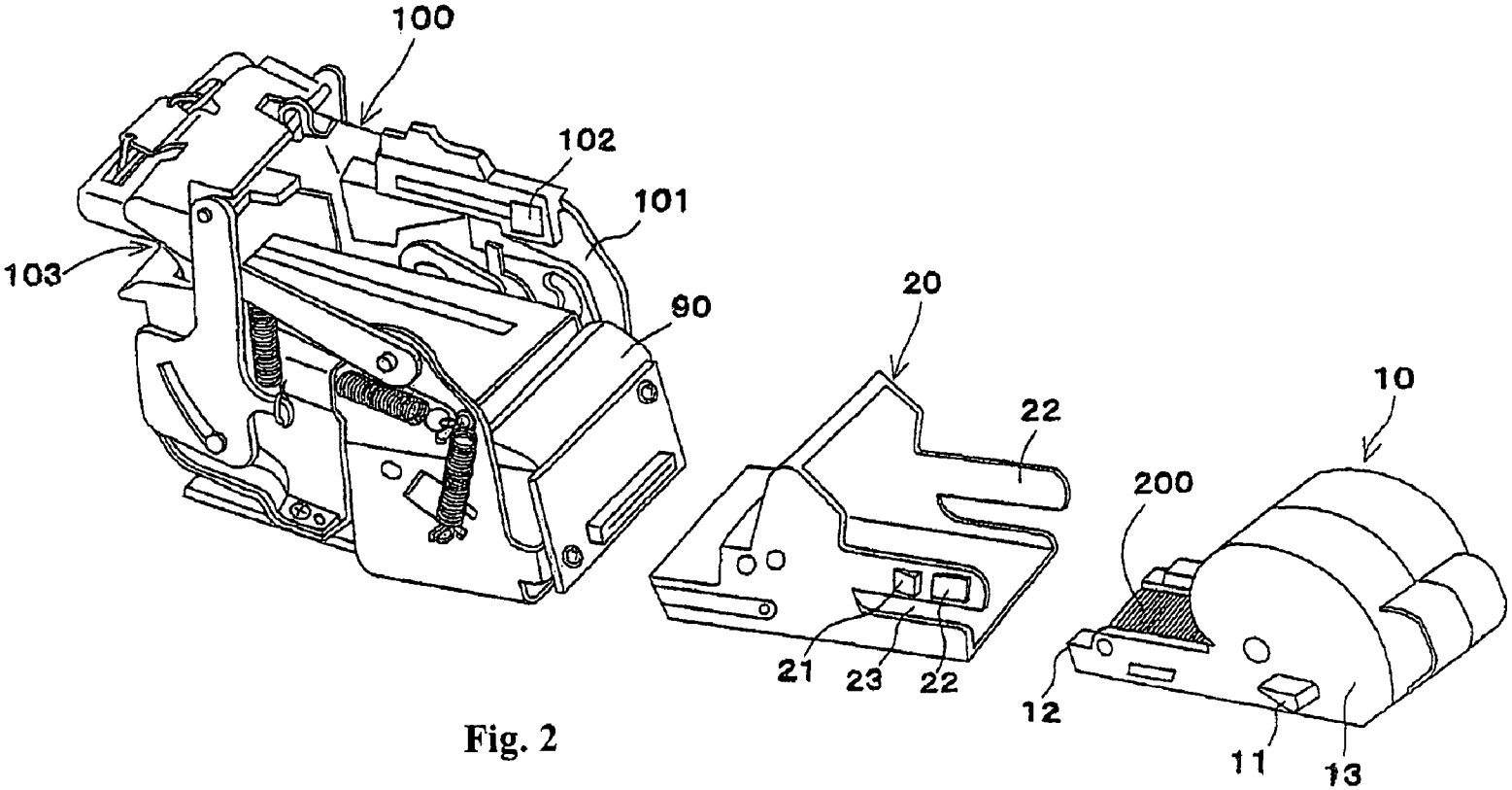
FIG. 2 is a partially exploded plan view of a staple replenishment mechanism of the stapler of FIG. 1.
Figure 11:
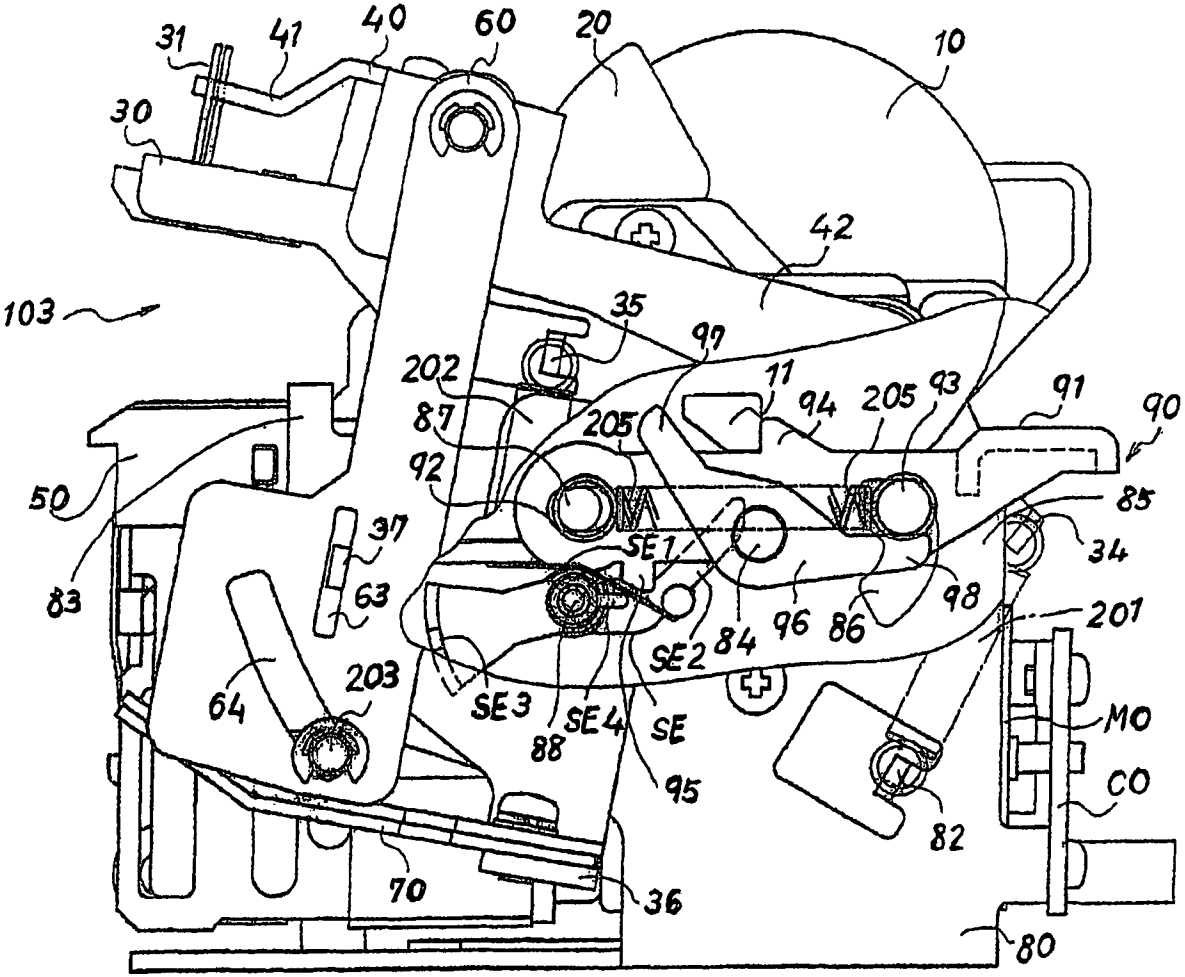
FIG. 11 is a partial cross-sectional view of the required parts that describe the state in which the lock lever has locked the cartridge in the stapler of FIG. 1.
Figure 12:
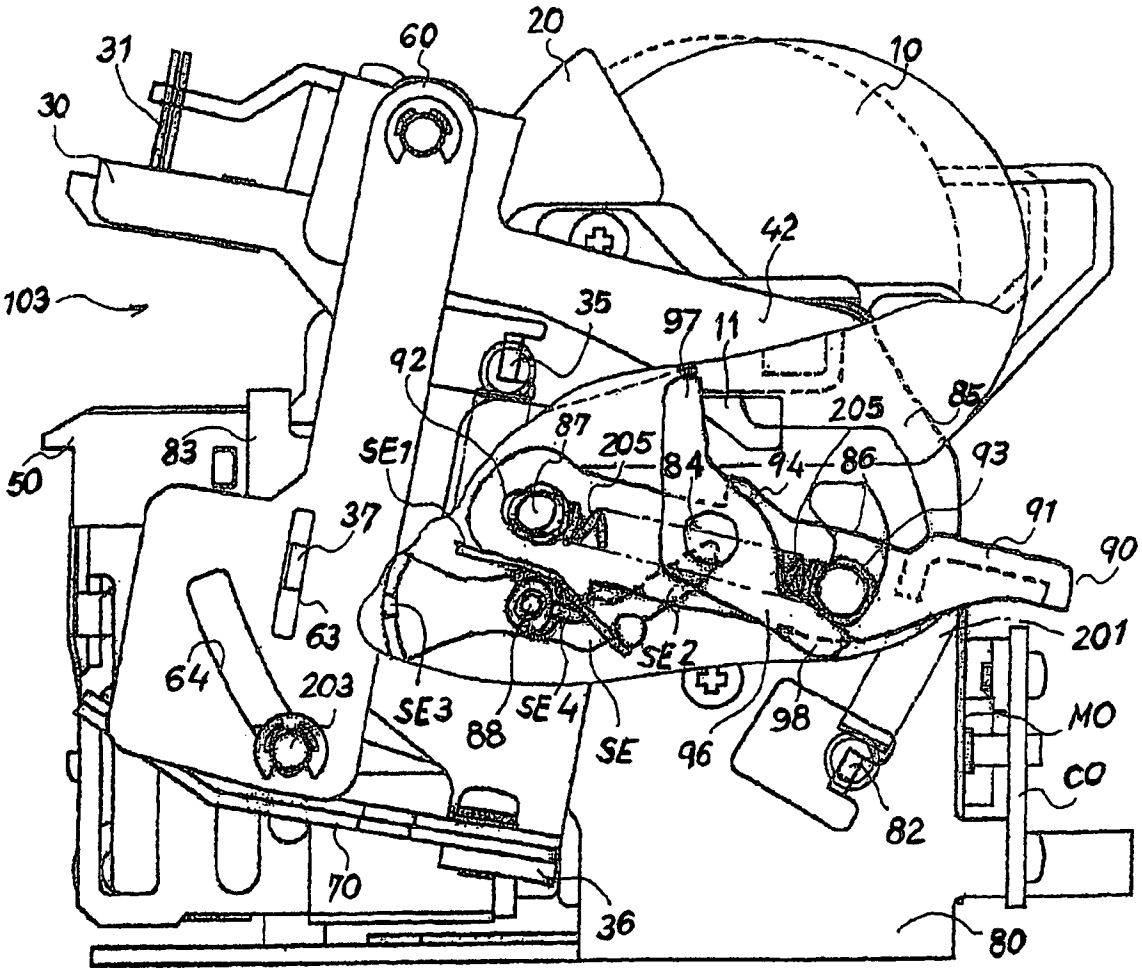
FIG. 12 is a partial cross-sectional view of the required parts that describe the state in which the lock lever has released the cartridge lock in the stapler of FIG. 1.

FIG. 2 is a partially exploded plan view for describing a staple replenishing mechanism of the same stapler device, which comprises a stapler device main body 100, a cartridge holder 20, and a staple cartridge 10. As the lock lever 90 is held down in an installation position, installation knobs 22 on the left and right sides of the cartridge holder 20 are first pinched together, and the cartridge holder 20 is guided by an installation guide 101 of the stapler main body 100 and installed therein. Detents 21 on the cartridge holder 20 are retained in catch holes 102 on the stapler main body 100. By guiding guide protrusions 11 on the staple cartridge 10 along installation guides 23 in the cartridge holder 20 and inserting staple end 12 in this state, as will be described later in FIG. 11, the guide protrusions 11 on staple cartridge 10 engage with a lock lever release lever 96 that releases a set lever by pushing it in, and thus the lock lever 90 is released from its locked state. By engaging the lock lever 90 while pushing the guide protrusions 11 on the staple cartridge 10 toward a staple driver 103 from the rear, the cartridge holder 20 and the staple cartridge 10 are retained in a state in which they are constantly urged toward the staple driver 103 of the stapler main body 100. Note that in the case of the staple replenishing mechanism, in order to try to make installation possible in the state in which the installation knobs 22 on the cartridge holder 20 are pinched inward, an installation procedure has been selected so that the cartridge holder 20 cannot be installed in the stapler device main body 100 when the staple cartridge 10 is inserted in the cartridge holder 20, and the cartridge holder 20 has been designed so that it cannot be easily detached from the stapler main body 100. Further, the method of urging the aforementioned cartridge holder 20 and the staple cartridge 10, and the method of locking by means of the lock lever 90, will be described in detail in the operational description of FIGS. 11 and 12 provided below. Note also the staple cartridge 10 stores staples 20 in a storage unit 13 therein, the staples 20 being straight, long and slender and grouped together side to side, linked together into a belt by means of an adhesive, and wound up into a roll. The staple end is prevented from returning back into the storage unit 13 by means of a staple non-return pawl not shown in the figures, and that end of the staples is stored in a state in which it abuts and is positioned on the tip portion 12 of the staple cartridge 10. Note that in this case, to store the staples 200 using a snail-shaped staple cartridge 10, the staples 200 are connected into a belt shape and wound into a roll, but depending on the structure of the staple cartridge 10, it is acceptable to use staples 200 that are stacked as sheets of staples connected into a belt shape.

Figure 3:
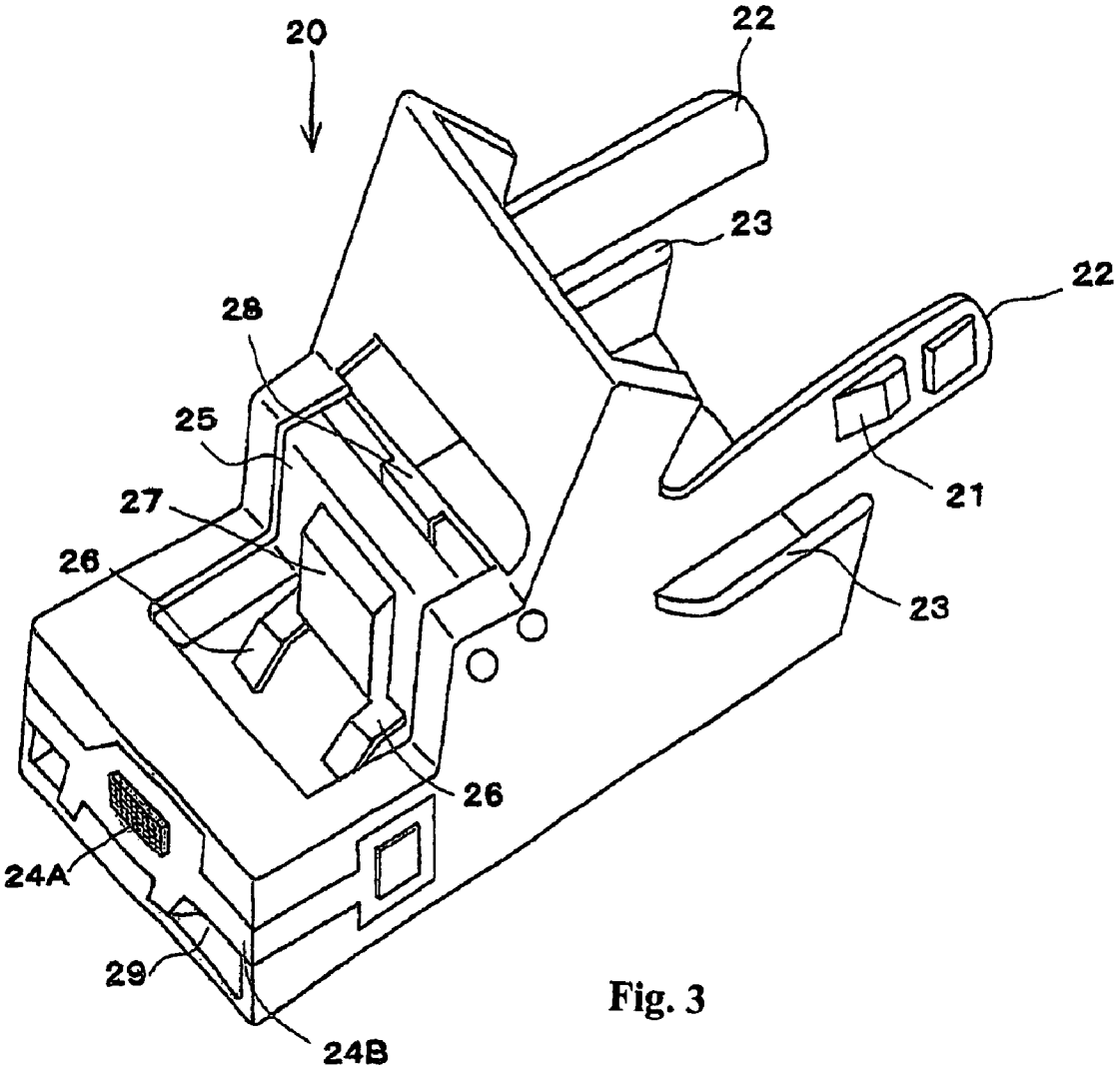
FIG. 3 is a plan view of a cartridge holder of the stapler of FIG. 1.

FIG. 3 is a plan view of the cartridge holder of the same stapler device which, other than the detent 21, the installation knobs 22, and the installation guides 23, comprises a magnet 24A that is disposed such that it faces a position that a crank portion passes through which joins both ends of a staple that has been formed into a U-shape and driven into a stack of sheets, and that serves to eliminate unsatisfactorily bound staples from the device that are generated during the stapling process in the front of the stapler main body 100 (in the installation direction) by detaching the cartridge holder 20. The cartridge holder 20 further comprises a non-magnetic magnet retaining member 24B made of stainless steel and formed into a U-shape such that it holds a front portion of the magnet 24A, the front portion thereof becoming a guide surface when a driver on the cartridge holder 20 slides, and a staple forwarding pawl means 25 that has a staple forwarding pawl 26 that steps the staples in the cartridge 10 to a stapling position 103 one by one and is pivotably supported on the lateral surfaces of the cartridge holder 20 at a forward pivot portion, and an engaging portion 27 that engages with protrusions on the clincher 40. The cartridge holder 20 also comprises a step pressing spring 28 that urges the staple forwarding means 25 in a stepped manner, and a hole 29 from which the staple tip portion 12 of the cartridge 10 projects. The process by which an unsatisfactory staple is removed from the stapler device when it is stuck between the stapler device main body 100 and the cartridge holder 20 will now be described. First, in the state shown in FIG. 1, by using one hand to push the set lever 90 downward, as described in detail in FIGS. 11 and 12 below, the lock on the cartridge 10 is released, the cartridge 10 is pushed out of the device, and the cartridge is then pulled out.

Next, as shown in FIG. 2, the installation knobs 22 on the cartridge holder 20 are pinched together, and by pulling out the cartridge holder 20 from the stapler device main body 100 in the state in which its engagement is released from the engagement holes 102 in the stapler device main body 100, the space between the stapler device main body 100 and the cartridge holder 20 is open. Because the staples that are jammed in this space are generally made of steel wire about 0.5 mm in cross-section, are cut into 25 mm lengths, are grouped together side to side and linked together into a belt by means of a synthetic resin type of adhesive, they are easily attracted to the magnet 24A. In this situation, because the staples have almost no weight and are easily attracted to the magnet 24A provided on the front portion of the cartridge holder 20, a flux density of 40 Gauss is sufficient. By pulling the cartridge holder 20 out of the stapler device main body 100, one can widen the space between the stapler device main body 100 and the cartridge 20 in which the jammed staple is sandwiched, jammed staples can be attracted to the magnet 24A, and can be taken out of the device while the cartridge holder 20 is pulled out of the stapler device main body 100.

Note that in this embodiment, the magnetic attraction force of the magnet 24A is used. However, by pulling the cartridge holder 20 out of the stapler device main body 100, jammed staples can be taken out therefrom, and instead of using the magnetic attraction force of the magnet 24A, the same effect can be easily obtained by replacing the magnet 24A or the staple facing portion of the magnet retaining member 24B with an adhesive such as adhesive tape. In addition, the magnet 24A or the staple attracting agent such as an adhesive or the like are attached to the cartridge holder 20 in this embodiment. However, even in a staple storage unit in which the cartridge 10 and the cartridge holder 20 are formed integral with each other, this can be attained by arranging it in a position that corresponds to the front portion of the cartridge holder 20 in which the magnet 24A is attached. Furthermore, the aforementioned staple feeding means is not limited to the staple feed pawl means 25 composed of staple feed pawl 26. It is acceptable if it possible to successively deliver staples to the staple driving position one by one by interlocking with the clincher so instead of the staple feed pawl means 25, it is possible to use a friction roller that touches the continuous sheet-shaped staples and rotates and can idle when necessary. Furthermore, the aforementioned staple feeding means has a structure provided with forward pressure spring 28 to urge the staple feed pawl means 25 forward, but it can have a structure capable of advancing staples with the operation of the clincher by one end being supported directly by the clincher and providing a feed pawl to the other end which touches the staples.

Figure 4:
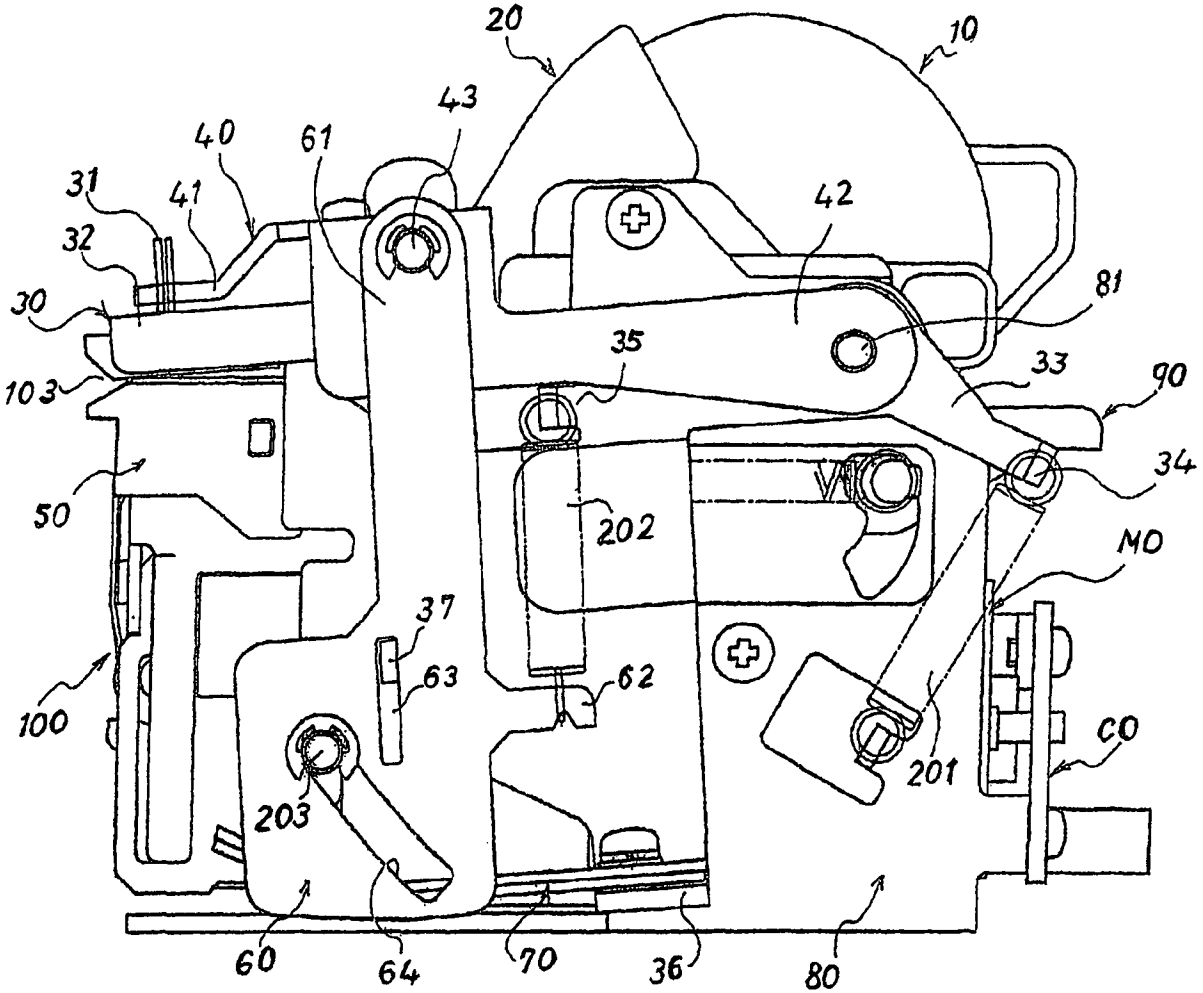
FIG. 4 is a lateral view of the stapler of FIG. 1.
Figure 5:
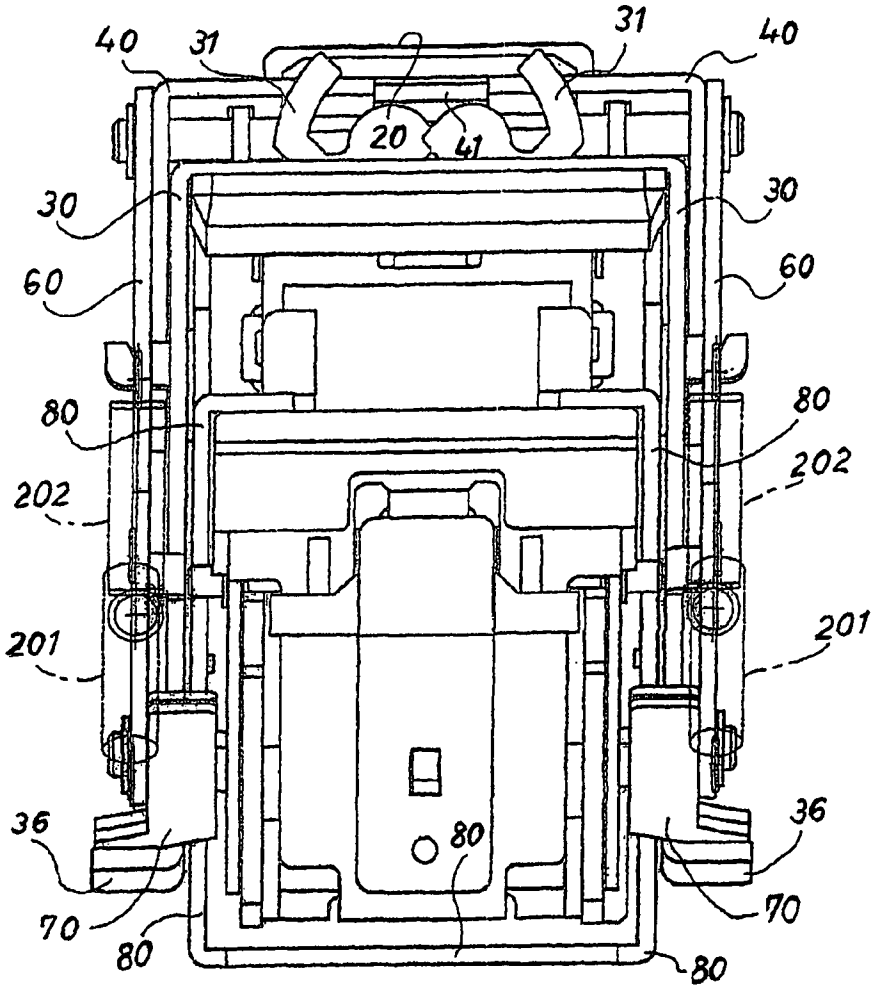
FIG. 5 is a front view of the stapler of FIG. 1.
Figure 6:
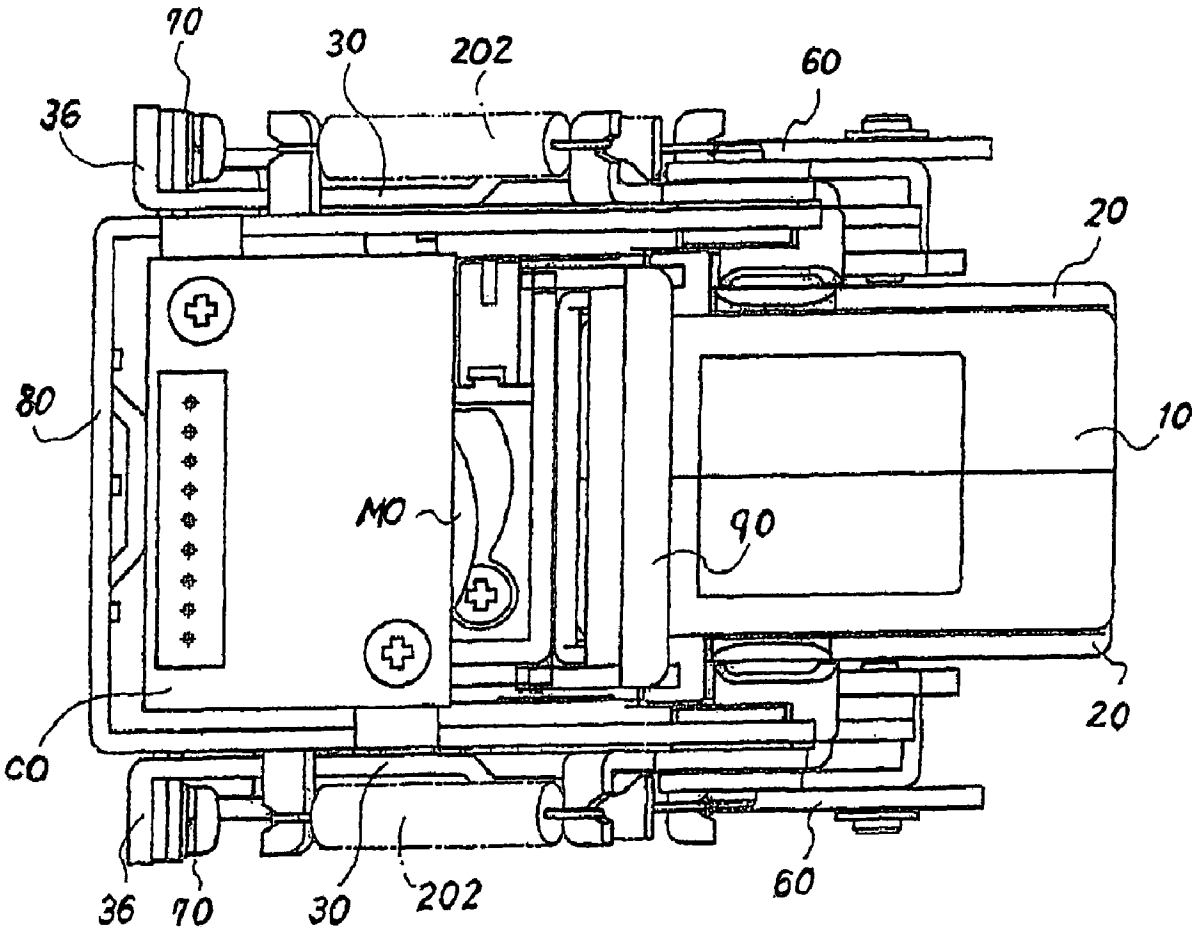
FIG. 6 is a back view of the stapler of FIG. 1.
Figure 7:
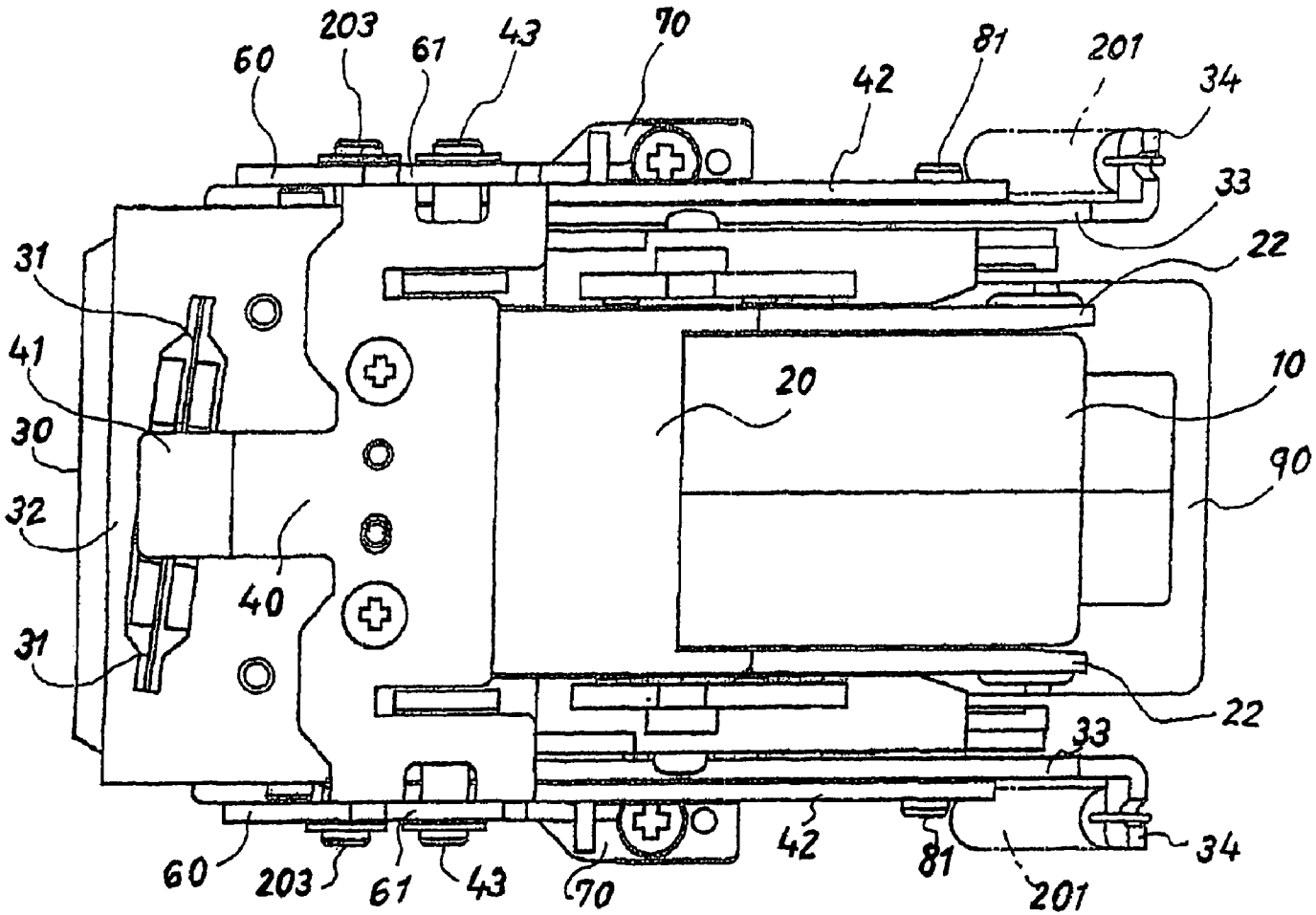
FIG. 7 is a top view of the stapler of FIG. 1.

FIG. 4 is a lateral view of the same stapler, FIG. 5 is a front view of the same stapler, FIG. 6 is a rear view of the same stapler, and FIG. 7 is a view of the top of the same stapler. The configuration of the components will now be described in accordance with FIGS. 4 to 7.

As shown in FIG. 2, the staple cartridge 10 is a snail-shaped, and has the guide protrusions 11, the storage section 13 that is a stapler case having a symmetrical shape from left to right and that can be split into two section from left to right, and stores the staples 200 that are staple sheets linked together into a belt and wound up into a roll, and a staple reverse prevention pawl 14 (shown in FIG. 9) that engages the front staple of the staples 200 such that it prevents it from returning back into the storage unit 13.

The cartridge holder 20 serves to hold the staple cartridge 10. However, a description thereof will be omitted because it was described in detail earlier in FIG. 3.

As shown in FIG. 5, the anvil unit 30 is an open U-shaped member in which the lower side thereof covers the top of the paper guide unit 50 disposed below it. The anvil unit 30 includes clincher arms 31 that pivot about a front pivot portion 32 overlooking the staple driver position 103 and which are respectively synchronous in the backward direction therewith, and engage with and fold a staple that has been sent out to the staple position, driven into a sheet bundle in a suitable position, and passed therethrough. The anvil unit 30 further comprises support arms 33 on which a fulcrum shaft 81 is pivotably supported. Plates on the left and right sides of the frame 80 are supported on and fixed to the fulcrum shaft 81, and extend toward the direction in which the cartridge 10 is installed in the staple driver position 103. The anvil unit 30 also comprises a bending protrusion 34 that is engaged with the frame 80 via a pulling spring 201 that is provided in a tensioned state therebetween, and a bending protrusion 35 that is engaged with one end of a pulling spring 202 that is engaged with the joint levers 60 via a pulling spring 201 provided in a tensioned state therebetween in order to constantly urge it in a direction away from the paper tray unit 50. The anvil unit 30 also comprises a leaf spring attachment portion 36 that is attached to the paper thickness absorbing leaf spring 70, which serves to release the drive interlock of the motor MO in response to the thickness of the paper bundle and prevent damage to the device, and a bending protrusion 37 that mates with a slit hole 63 in the joint levers 60, and serves to restrict movement of the joint levers 60.

Figure 10:
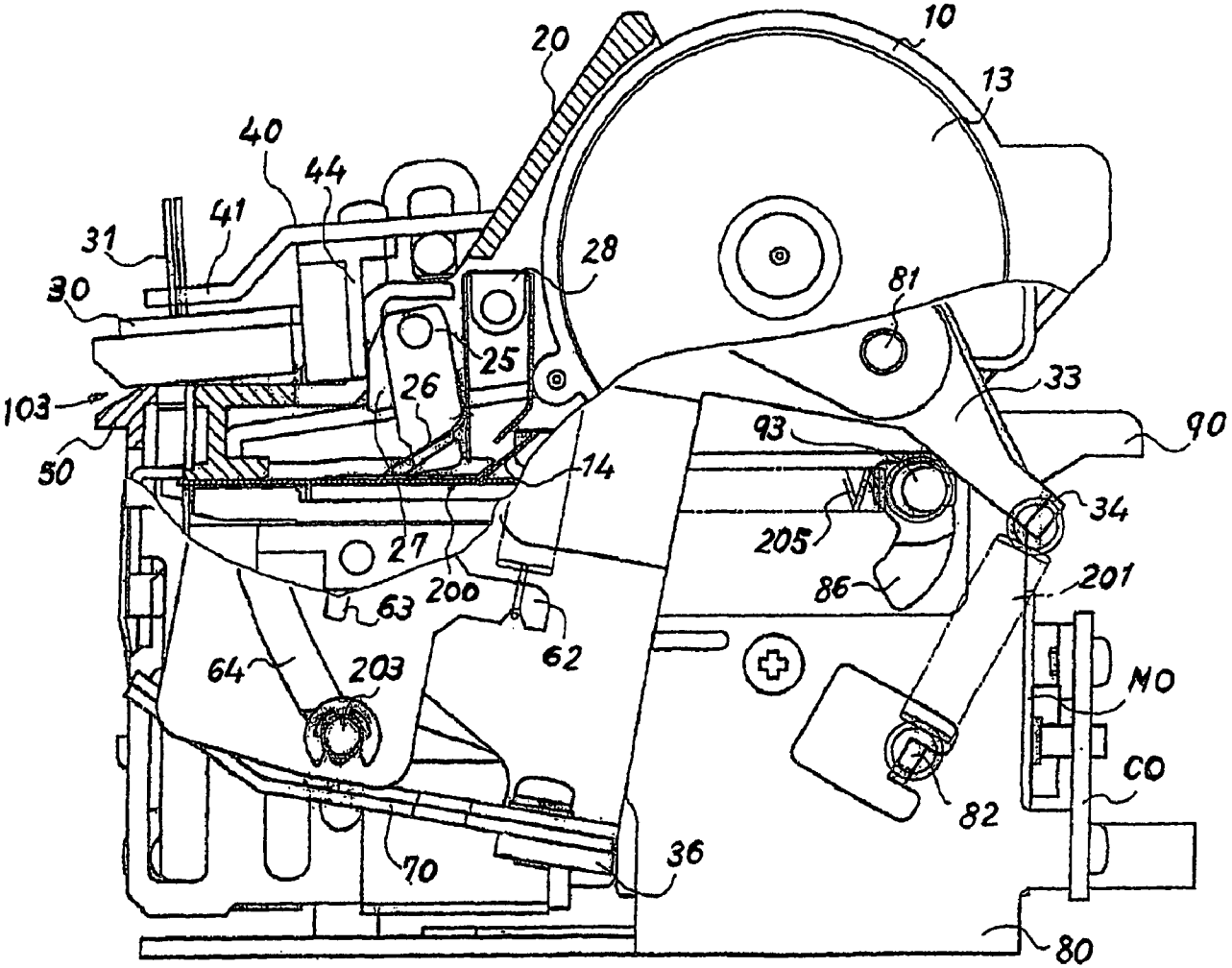
FIG. 10 is a lateral view of the stapler of FIG. 1 in the clincher clinch completion state.

The clincher 40 is a U-shaped member that is open on the lower side thereof like the anvil unit 30, and has a clinching unit 41 that pushes down on the anvil unit 30 and bends the staple, support arms 42 that are pivotably supported by the fulcrum shaft 81 that is the same fulcrum point for anvil unit 30, and a connection shaft 43 that passes through the central portion of the anvil unit 30 and connects the joint levers 60 therewith. Furthermore, as shown in FIG. 10 described later, the interlock projection 44 which drives the staple feeding means forward by engaging the staple feeding means with the clincher operation is formed and an interlock means is configured with the interlock projection 44 and engaging portion 27 on the staple feeding means.

The paper guide unit 50 is supported in its entirety by the device frame 80, and has a configuration in the front of the staple driver position 103 that is generally well known. It includes a former means that first forms a straight staple into a U-shape, and a driver means that drives the staple formed into a U-shape by the former means into a sheet bundle at the driver position.

Joint levers 60 connect the anvil unit 30 with the clincher 40 via the paper thickness absorbing leaf spring 70. Because they receive the rotation force of the motor MO and pivot the anvil unit 30 and the clincher 40, they have connection arms 61 that are rotatably supported on connection shaft 43 on the clincher 40 that extend upward, bending protrusions 62 that engage with the anvil unit 30 via pulling springs 202 provided therebetween in a tensioned state, slit holes 63 that mate with the bending protrusions 37 on the anvil unit 30 in order to restrict the position of the anvil unit 30, and slit holes 64 that receive the rotational force of the motor MO, and mate with a pivot shaft 203 in order to pivot the anvil unit 30 and the clincher 40.

When the anvil unit 30 that is pivoted by the joint levers 60 pushes down on a sheet bundle and reaches the point where it cannot pivot any further, the paper thickness absorbing leaf spring 70 is a spring for so-called paper thickness absorption which serves to block any further pivot connection. It comprises a leaf spring having a plurality of leaves for suitably adjusting the spring pressure, is open on one end thereof, and is attached to a leaf spring attachment portion 36 on the anvil unit 30.

The main body frame 80 is U-shaped and open at the top such that it contains the staple cartridge 10, the cartridge holder 20, the anvil unit 30, the clincher 40, and the paper guide unit 50 on both sides thereof. It also supports the paper guide unit 50 on the staple driver position 103 side, and supports the stapler drive mechanism disposed in the rear thereof as shown in FIG. 12. In addition, it supports an auxiliary frame 85 attached thereto and formed from a die. The auxiliary frame 85 has a cam groove 86, and shafts 87, 88, and supports a cartridge lock mechanism, a detection sensor that is used both to detect cartridge installation and when the staples have been exhausted, and the like.

As described explained above for FIG. 2, the lock lever 90 mountably supports the staple cartridge 10 and the cartridge holder 20 and constantly urges the staple cartridge 10 and cartridge holder 20 to the staple driver position 103. As shown in FIG. 11, the cartridge lock mechanism that includes the lock lever 90 is supported by the auxiliary frame 85. The lock lever 90 has a lock release knob 91 that is manually pushed downward when the staple cartridge 10 is removed, a slit hole 92 that is arranged so that the lock lever 90 can pivot forward and backward when the lock is released, a lock pin shaft 93 that moves in the cam groove 86 of the auxiliary frame 85 between a retain position that locks the staple cartridge 10 and a withdraw position that allows the staple cartridge 10 to be removed, a lock pawl 94 that engages the guide protrusions 11 on the staple cartridge 10, and a protrusion 95 for detecting arm withdrawal that, in the release position, withdraws and retains a detection arm SE2 on a no staples/cartridge installation detection sensor SE. In addition, the lock lever 90 has a lock release lever 96 that pivots in response to the lock lever 90 in the clockwise direction by moving the lock lever 90 that is in the locked, retain position to the withdraw position when the staple cartridge 10 is removed. Further, the lock pin shaft 93 is pivotably supported so that it constantly abuts the cam groove 86 in the auxiliary frame 85 by means of an urging spring 205. Note that the lock release lever 96 is rotatably supported by the shaft 84 on the main body frame 80, and has the contact arm 97 that abuts guide protrusions 11 on the staple cartridge 10 during cartridge installation on one end thereof, and the lock release arm 98 that moves the lock pin shaft 93 on the set lever 90 to the lock release position from the locked position on the other end thereof.

Motor MO is a drive source that bends staples in a stapler into U-shapes in one continuous process, drives the staples into sheet bundles, and bends the staples driven therein. It decelerates the rotations of a standard DC motor, and drives each element by controlling the cam means with this rotation.

The connector base CO connects an external control circuit with the motor MO, and a home position sensor (not shown in the figures).

As shown in FIG. 11, the no staples/cartridge installation detection sensor SE is pivotably supported by the shaft 88 on the auxiliary frame 85. The detection arm SE2 that extends to one side due to urging spring SE1 is urged to the position illustrated in the figure, in which it is able to detect whether or not the staples have been exhausted and whether or not a cartridge has been installed. A sensor detection protrusion SE3 on the other side thereof works together with a detection sensor not shown in the figures, and is able to detect whether or not the staples have been exhausted and whether or not a cartridge has been installed by detecting an ON/OFF state. Further, a protrusion SE4 in the area around the rotational shaft is pressed downward by means of the protrusion 95 on the lock lever 90 in order to retain the set lever 90 in the withdraw position during removal of the staple cartridge 10. Note that the state in the figure shows the detection of staples replenished in the cartridge or a cartridge having staples when mounting a cartridge and the detection arm SE2 in a state of touching a staple.

Figure 13:
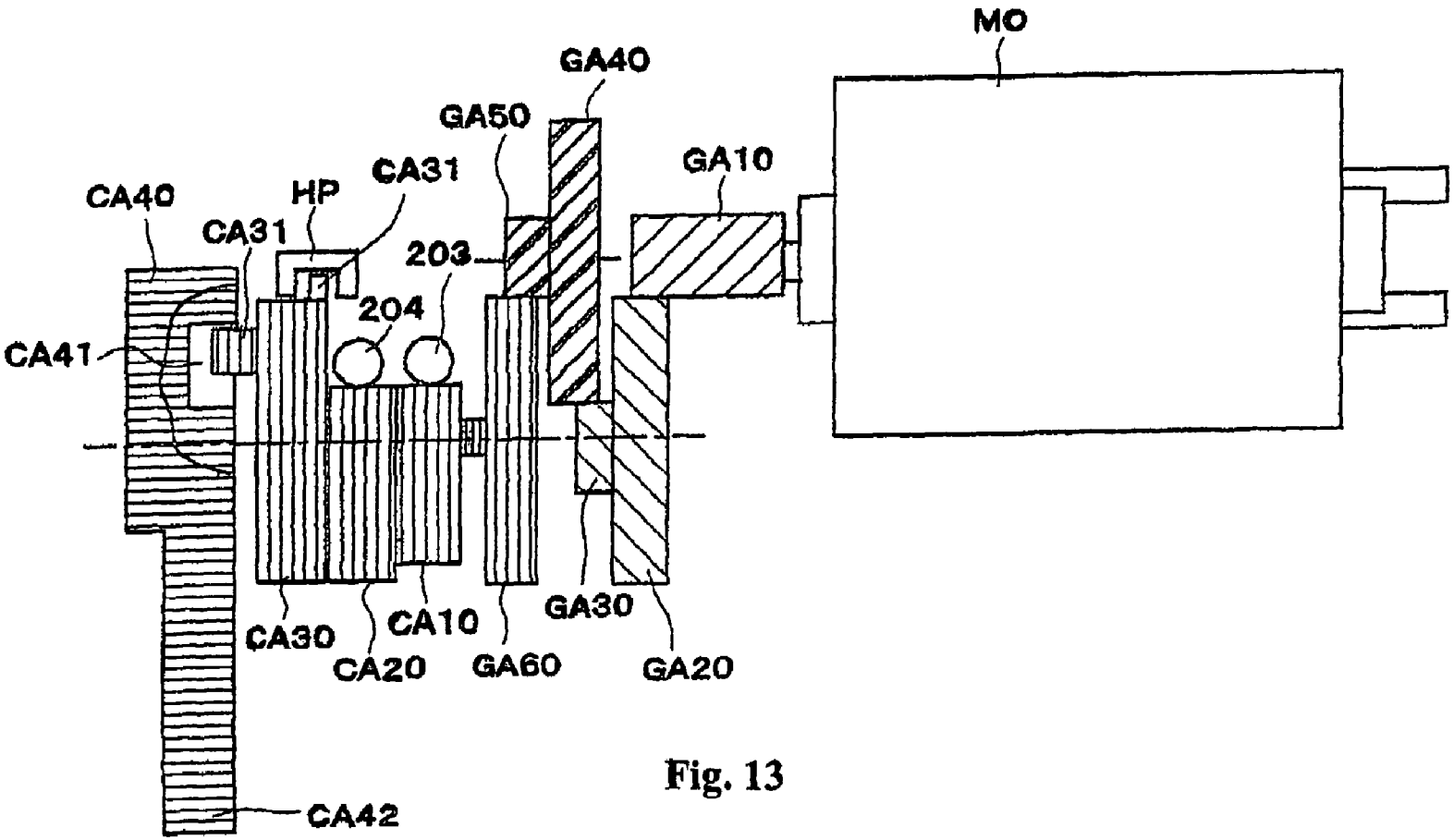
FIG. 13 is a schematic view that describes the driver drive system of the stapler of FIG. 1.

As shown in FIG. 13, stapler home position detection sensor HP is comprised of a detection sensor protrusion CA31 that is established in a suitable position overlooking an initial position on the circumferential surface of a driver cam rotor CA30 that rotates by means of the motor MO, and an optical detection sensor that is disposed in a suitable position on the stapler device main body 100.

Figure 8:
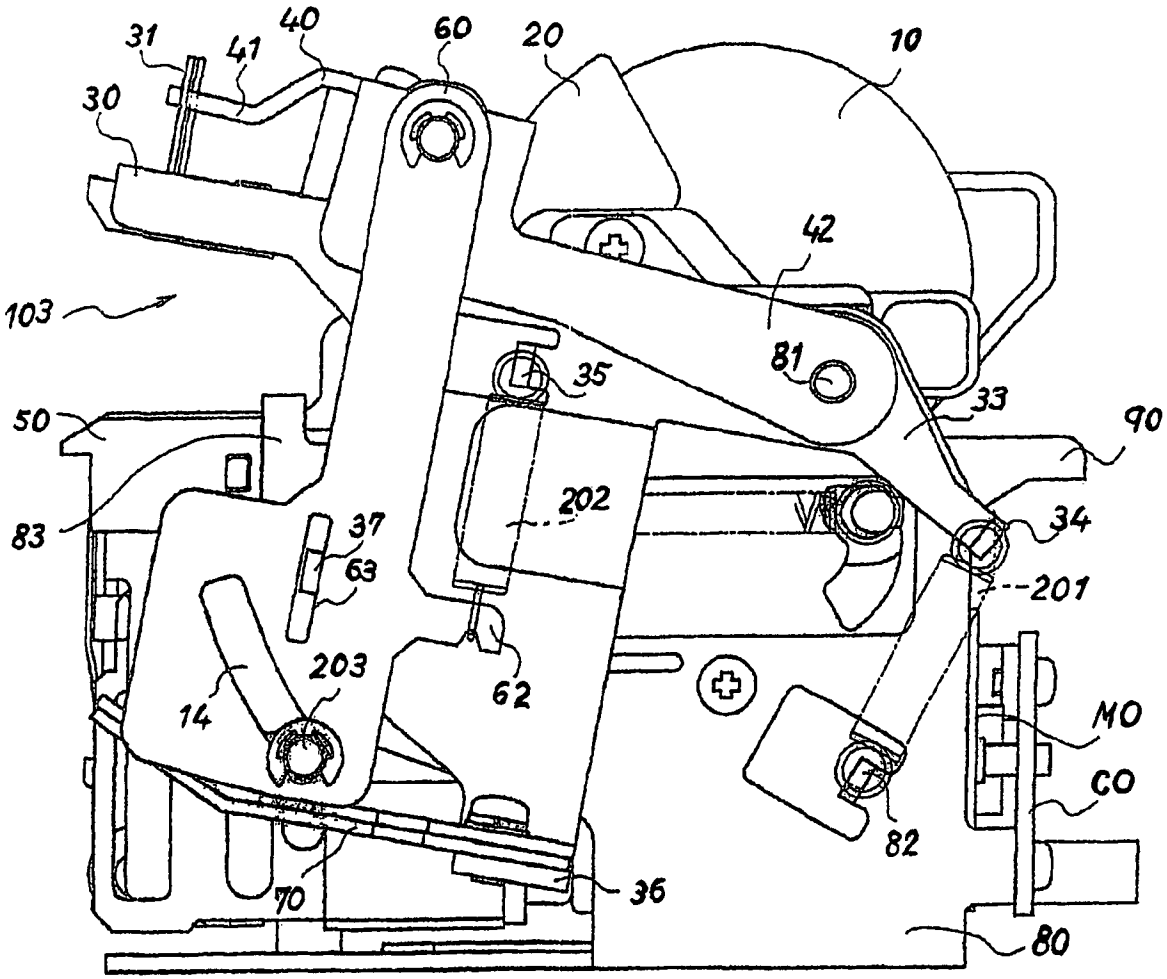
FIG. 8 is a lateral view of the stapler of FIG. 1 in the clincher idle state.

FIG. 8 is a lateral view of the clincher 40 of the same stapler in a clincher standby state. This position can always be detected by the home position sensor (not previously shown in the figures), and is a state in which stapling can occur after a stapling operation has been completed, after a jam has been cleared, or the like. A large opening is opened in staple driver position 103, and is in a standby state such that a sheet bundle can be inserted therein.

Figure 9:
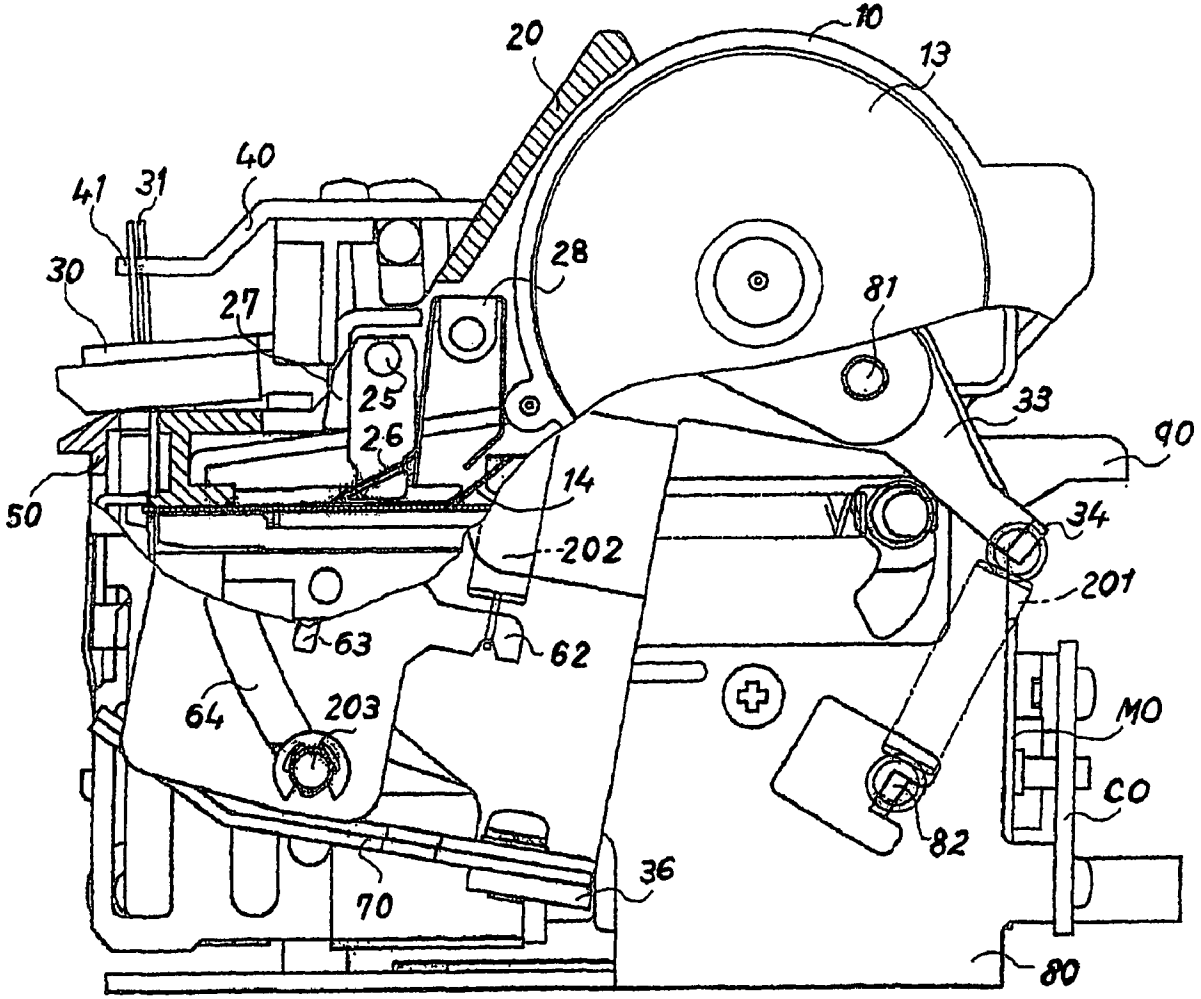
FIG. 9 is a lateral view of the stapler of FIG. 1 in the clincher sheet grasping state.

FIG. 9 is a lateral view of the clincher 40 of the same stapler in a sheet grasping state, and is shown in a state in which there are no sheets grasped therein in order to describe the maximum pivot limitation. In a real stapling operation, first the pivot of the anvil unit 30 is stopped within this pivot range due to the thickness of the sheet bundle, then clincher 40 pivots further and pivots the clincher arm 31.

FIG. 10 is a lateral view of the clincher 40 of the same stapler in a clinching completed state. In the state shown in FIG. 9, the interlock projection 44 formed by the clincher arm 31 pivots further, bends the tips of the staples, engages with the engaging portion 27 of the staple forwarding pawl 25 that is formed on the clincher arm 31, and the staple forwarding pawl 25 resists and is charged by the urging force of the step pressing spring 28. In this case, even if the staple reverse prevention pawl 14 does not engage with a staple and the staple connecting portion, and the staple returns half-way back, the staple has already been driven into the sheet bundle so jams do not occur when a staple returns half-way back or there is mis-positioning of the engaging position with the driver when driving a staple.

FIG. 11 is a partial cross-sectional view of the necessary components that describe the state in which the lock lever 90 of the same stapler device locks the staple cartridge 10, and shows a partial cross-sectional view of the necessary components of a lock mechanism for the staple cartridge 10 used when the staple cartridge 10 is installed in the stapler main body 100. The figure shows the staple cartridge 10 in the installed state, and locked and retained in the stapler main body 100, the lock lever 90 is urged in the direction of the staple driver position 103 by the urging spring 205 that comprises a tension spring that is stretched between the shaft 87 on the auxiliary frame 85 and the lock pin shaft 93 on the lock lever 90. The lock pawl 94 on the lock lever 90 engages with the guide protrusions 11 on the staple cartridge 10, and urge them toward the staple driver position 103. In the figure, gaps are provided between the slit hole 92 on the lock lever 90 and the shaft 87 on the auxiliary frame 85, and between the cam groove 86 in the auxiliary frame 85 and the lock pin shaft 93 on the lock lever 90, so that the lock lever 90 can move further in the direction of the staple driver 103. These gaps enable the set lever to retain and to lock the staple cartridge 10 in the retaining position without looseness at all times.

FIG. 12 is a partial cross-sectional view of the necessary components that describe the state in which the lock lever 90 of the same stapler device releases the lock on the cartridge 10. In the state shown in FIG. 11, when a staple is jammed between the staple main body 100 and the staple cartridge holder 20, or due to a staple replenishment signal to the user by means of a signal from the no staples/cartridge installation detection sensor SE, first, while the lock release knob 91 on the lock lever 90 is pulled out to the nip side around the shaft 87 on the auxiliary frame 85 by the slit hole 92, it resists the urging means 205 and the lock pin shaft 93 lowers along the cam groove 86 on the auxiliary frame 85 and to be retained in the state of the figure. In this state, the lock pin shaft 93 touches the engaging arm 98 on the interlock release lever 96 that releases the lock lever to pivot clockwise in resistance to the urging means, not shown in the drawing. The lock release arm 97 established on one end of the interlock release lever 96 to release the lock lever faces the position to engage the guide protrusions on the upper staple cartridge 10, as can be seen in the figure, and the lock release arm 97 pushes the staple cartridge 10 to the outside of the device. The cartridge is then pulled further out to replenish staples. In this state, the staple cartridge 10 having been replenished with staples is inserted into the stapler main body 100 thereby the staple cartridge 10 guide protrusions 11 touch the lock release arm 97 to push the lock release arm 97 counter-clockwise thereby the engaging arm 98 on the lock release arm 97 pushes the lock pin shaft 93 on the set lever 90 upward. The lock pin shaft 93 faces the lock position to lock along the cam groove 86 on the auxiliary frame 85, indicated in FIG. 11. At this time, the guide protrusion 11 on the staple cartridge 10 is at the position passing the engaging arm 98 and the guide protrusion 11 engages from behind by the engaging arm 98. The urging spring 205 constantly urges toward the staple position 103 direction to make the locked state shown in FIG. 11. Note that in the locked state, the staple cartridge 10 is constantly urged to the staple driver position 103 that the end of the staple 200 is retained at the staple end 12 to always position the ends of the staples at the appropriate position at the staple driver position 103 so that it is impossible for staples to be unnecessarily taken out.

FIG. 13 is a schematic view that describes the driver drive system of the same stapler device. It is composed of the drive motor MO that is comprised of a direct current motor, an output gear GA10, first and second reduction gears GA20 and GA30, third and fourth reduction gears GA40 and GA50, a fifth reduction gear GA60, a clincher drive eccentric cam CA10, an anvil drive eccentric cam CA20, a driver cam rotor CA30 that forms an engagement pin CA31, and a driver drive eccentric cam CA40 that forms the driver drive cam surface CA42 and the indentation mated by the engaging pin CA31. The pivot shaft 203 that pivots the clincher 40 abuts the clincher drive eccentric cam CA10, and the pivot shaft 204 that pivots the anvil unit 30 abuts the anvil drive eccentric cam CA20. In addition, the detection protrusion CA31 that detects the home position is configured to interrupt light at the home position to control the optical detection sensor HP established at the appropriate position on the stapler main unit 100 in one rotation.

DESCRIPTION OF OPERATION

Figure 14:
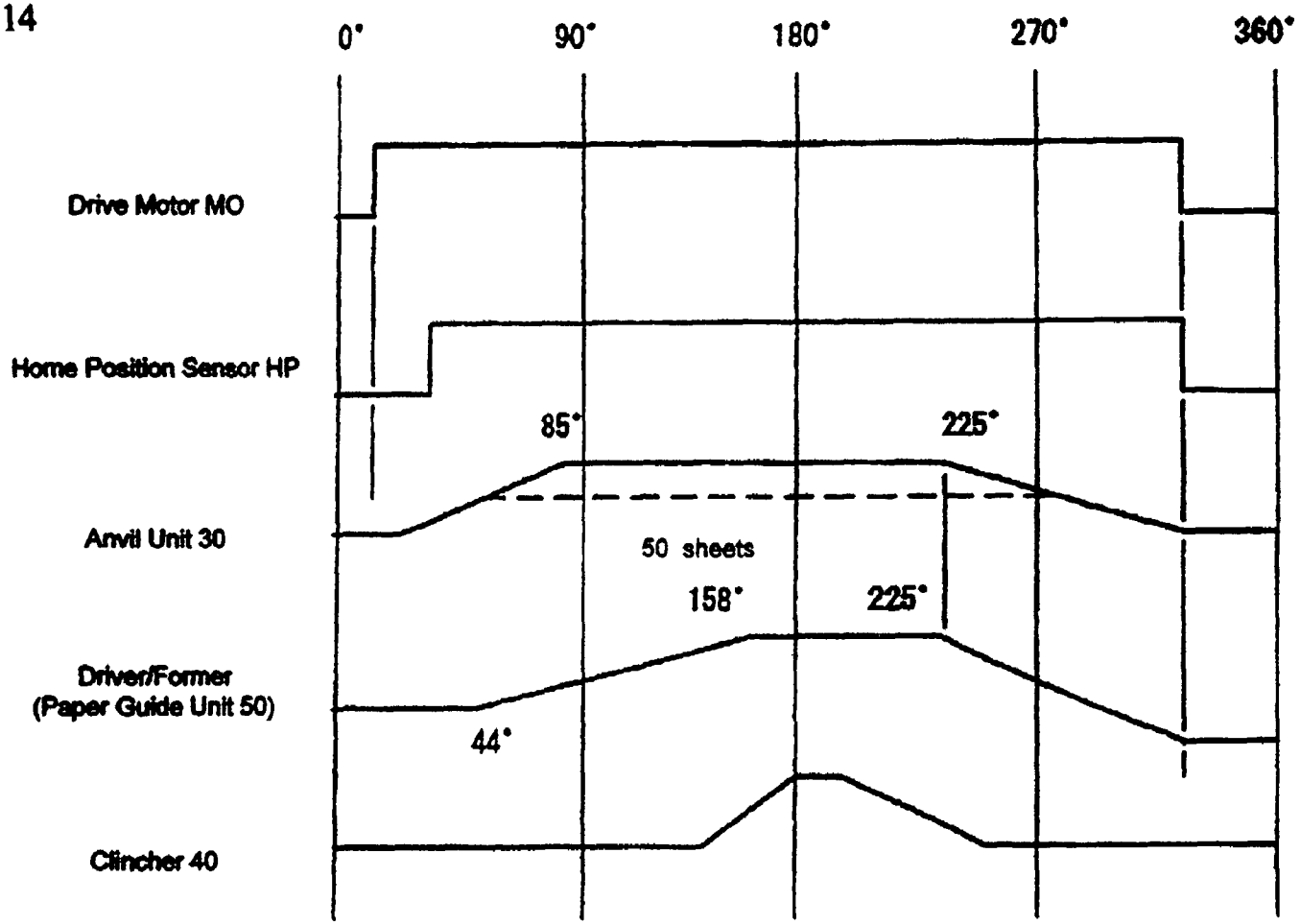
FIG. 14 is a timing chart that describes the serial operation of the stapler of FIG. 1.

FIG. 14 is a timing chart that describes the serial operation of the same stapler. This serial operation will be described by using this FIG. 14, the drive system of FIG. 13, and FIGS. 8 to 10. Drive motor MO receives a staple operation start signal from the device main body (not shown in the figures) and begins to rotate. As shown in FIG. 13, the output gear GA10 receives the rotation of the drive motor MO, and the sixth reduction gear 60 starts to rotate via the first through fifth rotation gears 10–50. The movement of this sixth reduction gear 60 corresponds to the movement of the drive motor MO of FIG. 14. First, the anvil pivot shaft 203 that abuts the anvil drive eccentric cam CA20 starts the pivoting of anvil unit 30 to pivot within a range of a maximum of 2 sheets in a plurality sheets in a sheet bundle to be sandwiched (rotational angle 85° of the sixth reduction gear 60) and 50 sheets which is the tolerable number of sheets in a bundle, indicated by the dotted line in the figure. When doing so, the anvil unit 30 sandwiches the sheet bundle and cannot swing farther so the swinging of anvil pivot shaft 203 that abuts the anvil drive eccentric cam CA20 is absorbed by the paper thickness absorbing leaf spring 70. The former and driver, not shown in the figures and driven by the driver drive cam CA40 shown in FIG. 1 is slidably supported in the vertical direction in the paper guide unit 50 moves slightly later than the pivoting of the anvil unit 30 and after the former has formed the straight staple ends into a U-shape, the driver continues to drive the staple ends formed into a U-shape into the sheet bundle an appropriate amount. Then, the pivot shaft 203 that abuts the clincher drive eccentric cam CA10 starts the pivoting of the clincher 40 to bend the ends of the staples driven into and having pierced through the sheet bundle an appropriate amount. After bending, the clincher 40 returns and anvil unit 30 and the driver and former return to complete one series of the stapling operation. Note that after starting the rotation of the drive motor MO, the home position sensor HP slightly later because of the rotation of the driver cam rotating body CA30 detects that the stapler device 100 is not in the home state or the prescribed initial state. By detecting whether or not it has returned to its initial state in the prescribed time, it checks to confirm the series of the stapler's operations and in the event that the home position sensor HP output after the prescribed operations is not recovered to its initial state, an error is determined for handling. Note, that although the starting of the operation is slightly delayed, in reference to the action of the drive motor MO, it is also possible to detect simultaneously.

As is clear from the foregoing description, according to the present invention, after driving a staple, interlocking with the aforementioned bending operation of a clincher means the staple feeding means operates to move staples to a driving position so the load applied on driving means to drive staples in bundles of sheets is reduced, and the staple driving operation into the bundle of sheets is executed smoothly thereby checking the occurrences of trouble such as defective binding.

What is claimed is:

1. A stapler apparatus operable with linked staples, the stapler apparatus comprising:

a staple feeding means for feeding staples to a driving position;

a driving means for driving the staples from the driving position into a stack of sheets;

a clincher means movably operable for bending staples driven by the driving means after the staples have entered the stack of sheets; and an interlock means coupled between the clincher means and the staple feeding means to tie operation of the staple feeding means to movement of the clincher means;

wherein the clincher means includes a contact portion to engage staples driven by the driver means and a clinch lever coupled to the contact portion to move the contact portion, the interlock means comprising the clinch lever and an engaging portion of the staple feeding means.

2. The stapler apparatus of claim 1, wherein the staple feeding means comprises a friction roller for rotating in contact with the linked staples.

3. The stapler apparatus of claim 1, wherein the staple feeding means comprises a reciprocating feed pawl in contact with the linked staples.

4. The stapler apparatus of claim 1, wherein the driving means and the clincher means are arranged on opposite sides of the linked staples and the staple feeding means is disposed on a same side of the linked staples as the clincher means.

5. A stapler apparatus equipped with linked staples, the stapler apparatus comprising:

a reciprocating staple feeding means that engages and feeds the staples, the staple feeding means including a resilient means to urge the staple feeding means in a staple feeding direction to feed staples toward a staple driving position;

a driving means to drive the staples from the driving position into a stack of sheets;

a clincher member operable to bend the staples driven by the driving means after the staples have entered the stack of sheets; and a clincher lever coupled to the clincher member and movable between a staple bending position, wherein the clincher member is operable to bend the staples, and a retracted position retracted from the staple bending position;

wherein the clincher lever and the staple feeding means engage when the clincher lever moves to the staple bending position, and disengage when the clincher lever moves to the retracted position.

6. The stapler apparatus of claim 5, wherein a resilient force is created in the resilient means by the movement of the clincher lever to the staple bending position, and the resilient force of the resilient means urges the staple feeding means in the staple feeding direction when the clincher lever moves toward the retracted position.

7. A stapler apparatus operable with linked staples, the stapler apparatus comprising:

a staple feed member configured to feed staples to a driving position;

a staple driver operable to drive the staples from the driving position into a stack of sheets; and a clincher movably operable to bend staples driven by the staple driver after the staples have entered the stack of sheets;

wherein the staple feed member is powered by movement of the clincher; and wherein the clincher includes a contact portion to engage staples driven by the staple driver and a clinch lever coupled to the contact portion to move the contact portion, and wherein the clinch lever selectively engages an engaging portion of the staple feed member to initiate the feeding of staples by the staple feed member.

8. The stapler apparatus of claim 7, wherein the staple feed member includes a reciprocating feed pawl in contact with the linked staples.

9. The stapler apparatus of claim 7, wherein the clinch lever is movable between a staple bending position, wherein the contact portion is operable to bend the staples, and a retracted position retracted from the staple bending position, and wherein the clinch lever and the engaging portion of the staple feed member engage when the clinch lever moves to the staple bending position, and disengage when the clinch lever moves to the retracted position.

10. The stapler apparatus of claim 9, further comprising:

a resilient member operable to urge the staple feed member in a staple feeding direction to feed staples toward the driving position;

wherein a resilient force is created in the resilient member by the engagement of the clinch lever with the engaging portion of the staple feed member, and the resilient force of the resilient member urges the staple feed member in the staple feeding direction when the clinch lever disengages from the engaging portion and moves toward the retracted position.

11. The stapler apparatus of claim 10, wherein the resilient member is a leaf spring.

12. The stapler apparatus of claim 7, wherein the clinch lever includes a projection that directly engages the engaging portion of the staple feed member.

13. The stapler apparatus of claim 7, wherein the staple driver and the clincher are arranged on opposite sides of the linked staples and the staple feed member is disposed on a same side of the linked staples as the clincher.

* * * * *